US005853139A

United States Patent [19]

Hehner et al.

[11] Patent Number: 5,853,139

[45] Date of Patent: Dec. 29, 1998

[54] PRESSURE ROLLER SYSTEM FOR A WINDING MACHINE

[75] Inventors: Reinhard Hehner, Haan; Georg Müller, Neuss; Hans-Friedrich Peters, Ratingen, all of Germany

[73] Assignee: Jagenberg Papiertechnik GmbH, Neuss, Germany

[21] Appl. No.: 973,186

[22] PCT Filed: Mar. 19, 1997

[86] PCT No.: PCT/EP97/01379

§ 371 Date: Nov. 24, 1997

§ 102(e) Date: Nov. 24, 1997

[87] PCT Pub. No.: WO97/39971

PCT Pub. Date: Oct. 30, 1997

[30] Foreign Application Priority Data

| | | | |
|---|---|---|---|
| Apr. 19, 1996 | [DE] | Germany | 196 15 539.8 |
| Dec. 11, 1996 | [DE] | Germany | 196 51 483.5 |

[51] Int. Cl.[6] ..... B65H 18/20; B65H 18/26

[52] U.S. Cl. ..... 242/530.1; 242/541.6

[58] Field of Search ..... 242/530.1, 530.3, 242/530.4, 541.6, 541.5, 547

[56] References Cited

U.S. PATENT DOCUMENTS

| | | | |
|---|---|---|---|
| 2,733,018 | 1/1956 | Nitchie | 242/541.6 |
| 3,503,567 | 3/1970 | Casey . | |
| 3,602,448 | 8/1971 | Muensterer . | |
| 4,026,487 | 5/1977 | Ales, Jr. . | |
| 4,867,387 | 9/1989 | Schonmeier | 242/541.6 |
| 5,165,618 | 11/1992 | Ruff | 242/541.6 |
| 5,518,199 | 5/1996 | Welp et al. | 242/541.6 |
| 5,553,806 | 9/1996 | Lucas | 242/547 |
| 5,785,271 | 7/1998 | Leskinen et al. | 242/541.5 |

FOREIGN PATENT DOCUMENTS

| | | |
|---|---|---|
| 0 521 681 A1 | 1/1993 | European Pat. Off. . |
| 27 09 740 | 9/1977 | Germany . |
| 42 01 327 A1 | 7/1993 | Germany . |
| 04341443 | 11/1992 | Japan . |
| WO 92/13787 | 8/1992 | WIPO . |
| WO 93/15009 | 8/1993 | WIPO . |

*Primary Examiner*—John M. Jillions
*Attorney, Agent, or Firm*—Herbert Dubno

[57] ABSTRACT

A winding machine for producing rolls (3) having a pressure roller system which includes a horizontal, vertically movable cross-head (8) to which a series of freely rotatable and individually movable roll segments (9) are secured side-by-side and with bolts parallel to the cross-head (8). In addition, there are piston/cylinder units (10) for adjusting the pressure exerted by the roll segments (9) on the rolls (3). Into the bearing of each roll segment (9) on the cross-head (8) is integrated a component which either increases the bearing pressure as the distance between the roll segment (9) and the cross-head decreases or decreases the bearing pressure as the distance between the roll segment (9) and the cross-head increases. Thus the most uniform possible pressure on all rolls (3) is ensured and negative effects owing to excessive differences in diameter between the rolls (3) are prevented.

16 Claims, 3 Drawing Sheets

PRESSURE ROLLER SYSTEM FOR A WINDING MACHINE

CROSS REFERENCE TO RELATED APPLICATIONS

This application is the US national phase of PCT application PCT/EP97/01379 filed 19 Mar. 1997 with a claim to the priority of German applications 196 15 539.8 and 196 451 483.5 respectively filed 19 Apr. and 11 Dec. 1996.

FIELD OF THE INVENTION

This invention relates to a pressure-roller system for a winding machine for winding up material webs, in particular from longitudinally subdivided paper or cardboard webs. More particularly this invention relates to a pressure roller system for a winding machine for making winding rolls with a horizontally extending and vertically movable traverse on which is mounted a row of freely rotatable and individually vertically movable roller segments with axes parallel to the traverse and with means for controlling the contact pressure the roller segments bring to bear on the winding rolls and to a winding machine with a pressure-roller system according to the invention.

BACKGROUND OF THE INVENTION

In order to wind paper or cardboard webs up on winding rolls, support-roller winding machines are used that have two driven support rollers on which the winding rolls lie during winding, coaxially in line with one another. Above the roll cradle formed by the support rollers is a pressure-roller system that is formed by a throughgoing pressure roller or individual pressure-roller segments that are mounted on a horizontal vertically movable traverse. The pressure-roller system serves at the start of winding to press down on the winding rolls in order to increase the line load at the contact line between the winding rolls and the support rollers. The line load mainly determines the winding hardness of the winding rolls. At the start of winding the actual weight of the winding rolls is insufficient so that a pressure-roller system brings to bear an increased contact pressure that is decreased with increasing winding-roll weight during the winding operation.

Since variations in cross section in the web lead in winding longitudinally subdivided paper or cardboard webs to different winding-roll diameters, a throughgoing pressure roller does not contact winding rolls of smaller diameter. In order to solve this problem, a pressure-roller system is known from WO 93/15009 wherein a row of freely rotatable roller segments are mounted next to one another for independent vertical movement relative to the traverse. Each roller segments can thus be set for the diameter of the winding roll underneath itself. In order that the contact pressure created by the weight of the pressure-roller system is equal with each roller segment, the roller segments are connected to respective hydraulic piston-cylinder units that are connected together in a closed system.

In practice it has been shown that this advantageous system has problems when used with webs with thicknesses varying crosswise. Since the pressure-roller segments press independently of the winding roll diameter with the same pressure against the winding rolls, any variation in diameter between the winding rolls is ever greater. As a result of the fact that all the winding rollers are driven at the same web-travel speed (=peripheral speed of the support rollers), the result of different winding-roll diameters is a different rotational speed, that is winding rolls with smaller diameter are rotated faster. A difference in rotational speed between two adjacent winding rolls causes rubbing at their adjacent ends which leads to undesired effects such as marking, burns, and in extreme cases to loss of a roll when adjacent winding rolls with different diameter catch on each other.

OBJECT OF THE INVENTION

It is an object of the invention to provide a pressure-roller system that on the one hand maintains as uniform a contact pressure as possible on all winding rolls and on the other hand avoids negative effects caused by excessive variations in diameter.

According to the invention each roller segment has integrated into its vertical guide an element that controls the contact pressure in dependence on its spacing from the traverse. The contact pressure is either reduced when the spacing from the traverse increases or it is increased when the spacing decreases. This causes all diameter variations to tend toward an average diameter in that winding is done either tight or less tight.

BRIEF DESCRIPTION OF THE DRAWING

The drawing serves for describing the invention with reference to two simplified illustrated embodiments.

Therein.

MODE OF CARRYING OUT THE INVENTION

Figure 1:
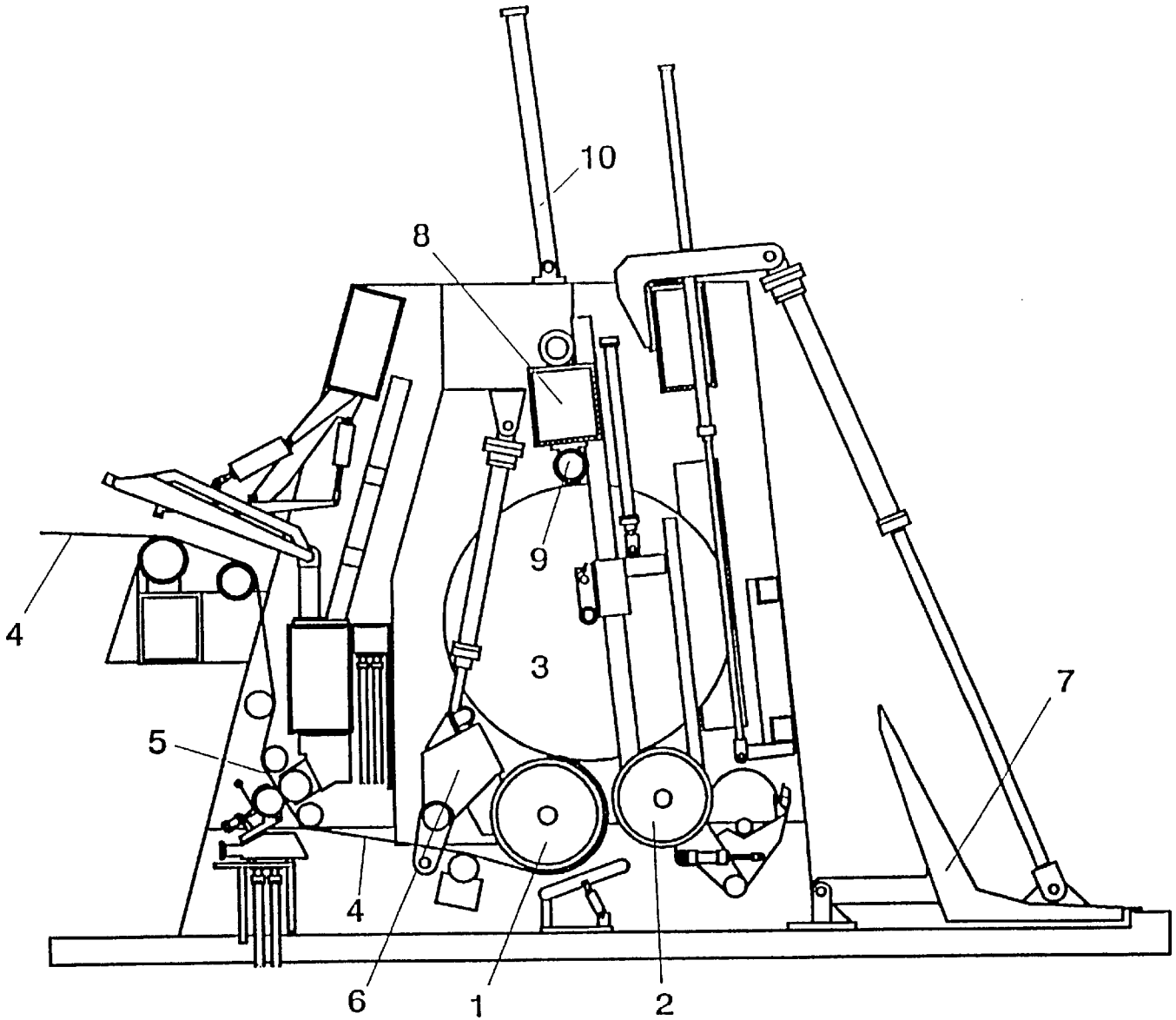
FIG. 1 is a side view of a support-roller winding machine with a pressure-roller system according to the invention.

The support-roller winding machine shown in FIG. 1 has two driven support rollers 1 and 2 that form a roll cradle in which the winding roll 3 lies when winding on the support rollers 1 and 2. The paper or cardboard web 4 is subdivided by a longitudinal cutter 5 into individual webs that are then guided through the gap between the support rollers 1 and 2 in the roll cradle where they are wound up on respective aligned sleeves. The winding machine has further the known elements for removing full winding rolls 3 and for placing new sleeves (knockout beam 6, winding roll drop table 7).

The frame of the winding machine holds above the roll cradle a pressure-roller system with which at the start of winding the effective weight of the winding rolls 3 on the support rollers 1 and 2 can be increased when the actual weight of the winding rolls is not sufficient to obtain the desired winding hardness.

The pressure-roller system comprises a horizontal traverse 8 that extends transverse to the web-travel direction and that is vertically movable. The underside of the traverse 8 carries a row of adjacent roller segments 9 with axes parallel to the traverse 8 and which lie on the winding rolls 3 on lowering of the traverse 8. With a machine working width of about 8 m the axial length of one segment is about 100 mm, its diameter about 260 mm. Each side of the machine has a hydraulic piston-cylinder unit 10 that can move the traverse 8 with the roller segments 9 upward into a rest position. Similarly the piston-cylinder units 10 can also relieve the downwardly effective contact pressure of the roller segments 9 on the winding rolls by upward pressurization.

Figure 3:
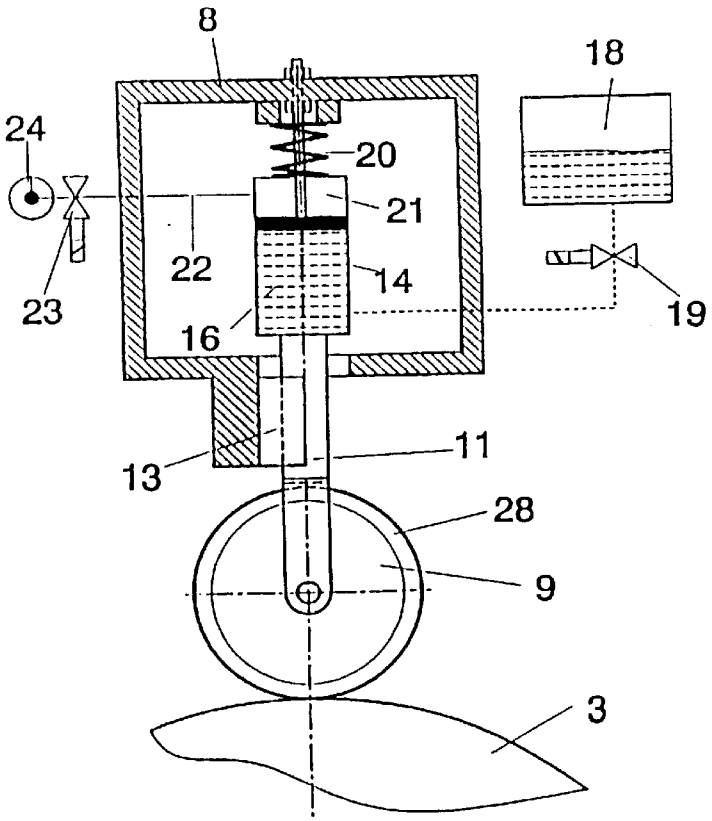
FIG. 3 is a detail in longitudinal section.
Figure 2:
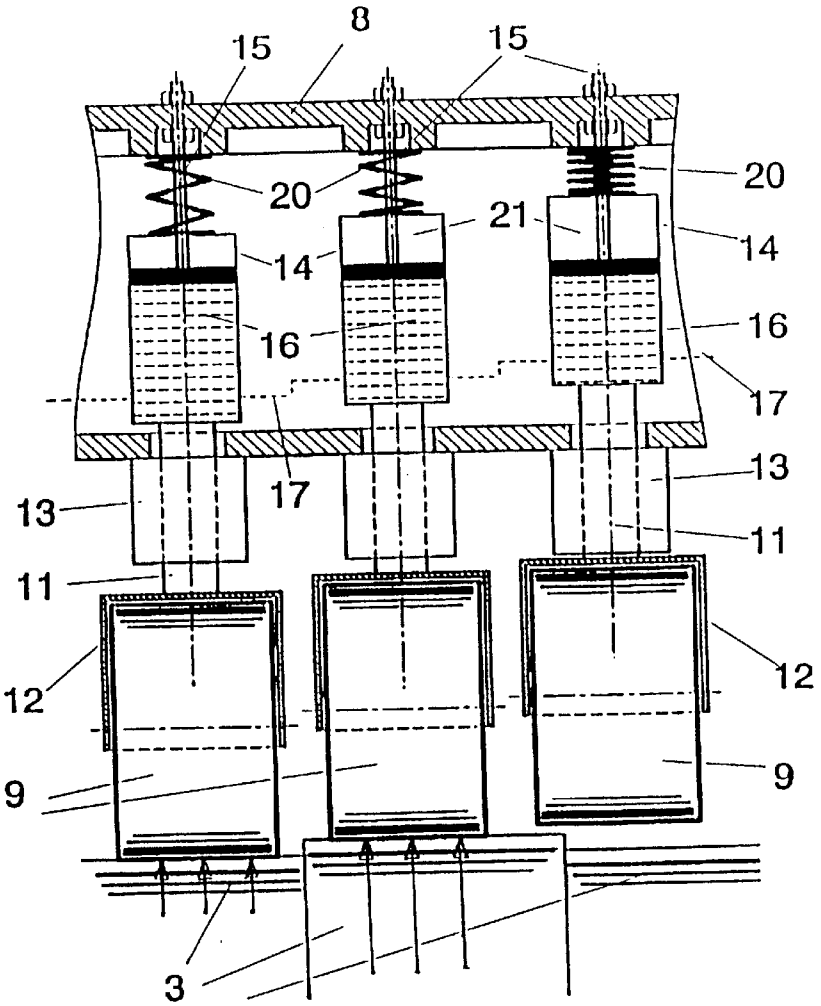
FIG. 2 is a cross section through the pressure-roller system.
Figure 4:
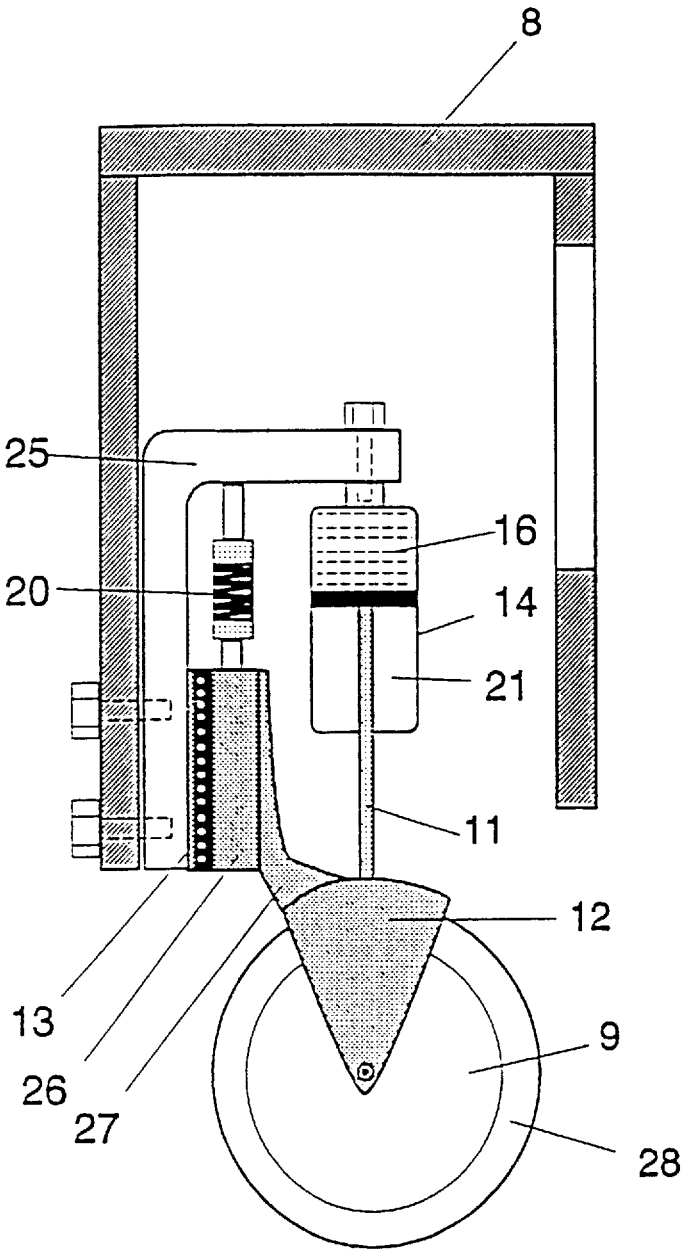
FIG. 4 is a detail in longitudinal section of a further embodiment.

The constructions of two embodiments of a pressure-roller system according to the invention are shown in FIGS. 2, 3, and 4.

In both embodiments the traverse 8 is formed as a hollow profile that has on its underside along its entire length (=working width of the machine) a row of openings each guiding an outwardly extending mounting rod 11 on whose lower end is a bearing unit 12 for a roller segment 9. The roller segments 9 are each freely rotatable in a respective downwardly open bearing unit 12.

Preferably each roller segment 9 is formed of a hollow cylindrical support of a rigid material, in particular steel, whose outer surface carries a limitedly deformable layer 28 of a cellular plastic material with a multiplicity of uniformly distributed pores. The plastic material formed of a cellular elastomer, in particular polyurethane, has a modulus of compression K of less than 10 MPa, preferably between 1 MPa and 5 MPa. The size of the pores is less than 5 mm, preferably between 0.05 and 1 mm. Preferably the pores in the deformable layer are partially open, that is interconnected, and partially closed. The proportion of open pores is 30% to 70%, preferably about 50%. The ratio of open to closed pores determines both the compressibility as well as the ability of the layer to dissipate internally created heat in order to avoid unwanted overheating. The density of the plastic material is between 350 $kg/m^3$ and 700 $kg/m^3$. The thickness of the layer 28 formed by it is 8 mm–40 mm, preferably 10 mm–20 mm, in the example about 15 mm. A compressible layer 28 with the above characteristics has shown itself particularly suitable to bring to bear the necessary contact pressure without marking the winding rolls 3 under different operational circumstances, e.g. deviations in profile in the web 4.

The outer surface of the support body can carry instead of a layer 28 of a naturally compressible material also a layer of a rubber-like material. In this case a material with a Shore A hardness of 60–90 is used in whose outer surface are formed annular and concentric grooves so that air can escape. The lands are between 2.5 to 2 mm wide and the grooves are about 2 mm deep have a width of at most 3 mm. The thickness of the layer of the elastomeric material also is 8 mm to 40 mm, preferably 10 mm to 20 mm.

Outside (FIGS. 2 and 3) or inside (FIG. 4) the traverse 8, each mounting rod 11 of each roller segment 9 is guided in a vertical but nonrotatable linear guide 13 that is also fixed on the traverse 8. In the embodiment according to FIGS. 2 and 3 the linear guides 13 are fixed on the underside of the traverse 8 while in the embodiment according to FIG. 4 they are inside the hollow profile on one longitudinal wall. The linear guides 13 each preferably contain a lower prestressed ball bearing so that its two parts are mounted for play-free vertical movement relative to each other. The upper end of each mounting rod 11 is fixed inside the traverse 8 on an upright double-acting piston-cylinder unit mounted there. The piston-cylinder units are double-acting membrane cylinders which each have a chamber 16 filled with a liquid, e.g. hydraulic fluid, so that they are hydraulically actuatable. The liquid-filled chambers 16 of all the cylinders 14 are connected together in a closed system via conduits 17 so that the same hydraulic pressure is present at all times in each chamber 16. The closed conduit system 17 is connected via a valve 19 to an equalizing chamber 18 into which fluid can flow from the closed system when the valve 19 is open. The hydraulic pressure in the chambers 16 thus presses the roller segments 9 when engaged with the winding rolls 3 against the traverse 8. It transmits the downward weight (reduced as desired by that of the piston-cylinder units 10) of the pressure-roller system and thus exerts the desired contact pressure from the segments 9 on the winding rolls 3, all segments 9 bearing at all times with the same contact pressure except as corrected as described below.

In the embodiment according to FIGS. 2 and 3 the pistons 15 of the piston-cylinder units are each screwed fixedly into the upper wall of the traverse 8. Each cylinder 14 of each unit is limitedly vertically movable so that the spacing of each roller segment 9 from the traverse 8 can be established individually.

In the embodiment according to FIG. 4 each cylinder 14 of each unit is screwed with its upper end in the horizontal leg of an angle iron 25 whose other leg is screwed to the inner face of the longitudinal wall of the traverse 8. In this embodiment the movable piston carries the mounting rod 11 on which the respective roller segment 9 is mounted. The linear guide 13 is mounted inside the angle iron 25. Its movable part carries the holder for the bearing unit 12 of the respective roller segment 9 so as to ensure vertical nonrotating linear movement.

The correcting system is formed of elements that are integrated into the guide for vertical movement of each roller segment 9 on the traverse so that either on decreasing spacing of a segment 9 from the traverse 8 the contact pressure on the winding roll 3 is increased by an additional contact pressure that depends on spacing or on increasing spacing the contact pressure is decreased by a counter pressure that grows in dependence on spacing.

In the embodiment according to FIGS. 2 and 3 the correcting system comprises compression springs 20 that are each braced between the respective cylinder 14 and the upper wall of the traverse 8 around the respective piston rod 15 in this region. Each compression spring 20 thus works against movement of the respective segment 9 toward the traverse 8 with a force increasing with upward travel. This works against wide diameter variations in the winding rolls 3 for the following reasons:

As a result of the closed hydraulic system of the chambers 14, a relative increase of a winding-roll diameter (e.g. as a result of a change in transverse section of the web 4) leads to a relative movement of the respective roll segment 9 toward the traverse 8. This movement is increasingly opposed by the force of the compression spring 20, that is in addition to the hydraulic pressure—the same for all segments—the upwardly pushed segments 9 also increase the spring force of the compression springs 20 downward on the winding rolls 3. Depending on the difference in diameter as a result of the increased pressure, winding will be tighter so as to act against any further increase in diameter variation. The size of the counter force with outward deviation can be set by appropriate selection of spring constants so that the correction only starts with negatively effective diameter variations in order to use in a range of acceptable variations the same contact pressure for a uniform winding hardness.

It is alternatively possible to mount the springs 20 on both ends of the upper wall of the traverse 8 and on the cylinder 14 so that they are effective as tension springs with travel-dependent increasing force on the respective segments 9. This leads to winding rolls 3 of relatively small diameter being wound more softly so that they increase in diameter. This also works against an undesired large variation between the diameters of two adjacent winding rolls 3.

In the embodiment according to FIG. 4 the compression spring 20 is between the horizontal leg of the angle iron 25 and the movable part 26 of the linear guide 13 and thus works with increasing force against relative movement of the roller segment 9 toward the traverse 8.

If a roller segment 9, as shown in FIG. 2 for the right-hand segment, is above a longitudinal cut, thus in the region of two winding rolls 3 it must be taken out of service for this format. The same is true for segments 9 which when working with narrow webs 4 are outside the web width. The double-acting piston-cylinder units according to the embodiment make it possible to use the second chamber 21 in order to raise a segment 9 into an inactive position.

Every second chamber 21 of a cylinder 14 is connected via a respective pressure line 22 with a valve 23 via which the pressure medium, preferably air, can be connected to a common source 24 and similarly the pressure can be let out of the chamber 21. A pressure increase in the chamber 21 leads to a raising of the segment 9 so long as the hydraulic pressure in the other chamber 16 is less.

The use of double-acting piston-cylinder units makes it possible to carry out the corrective function by control of the pneumatic pressure in the chamber 21 instead of with the springs 20. In this alternative which is not shown in the embodiment in the drawing the pressure-roller system has a controller which controls the pneumatic counter pressure in the respective chamber 21 dependent on travel so that with a falling spacing of the roller segment 9 from the traverse 8 the counter pressure is increased in order to increase the contact pressure the roller segment 9 brings to bear or with increasing spacing the contact pressure the roller segments 9 bring to bear is decreased dependent on travel by increasing the counter pressure. In the embodiment according to FIG. 4 with a lower pneumatic chamber 21, on relative movement of the roller segment 9 downward, thus with increasing spacing of the segment 9 from the traverse 8, the upwardly effective pneumatic pressure in the chamber 21 increases in order to decrease the contact pressure brought to bear by the segments 9.

Setting up the system, including activating the desired segments 9 is carried out as follows at the start of winding:

First with the valve 19 open, that is with the hydraulic system open into the equalizing chamber 18, each cylinder 14 is moved all the way up against the force of the respective spring 20 by pneumatic pressure in the chamber 21 so that all the segments 9 are in the upper inactive position.

Subsequently the valves 19 for the segments 9 needing to be activated are opened. Their chambers 16 fill with hydraulic fluid until the segments 9 drop to a central working position in their travel. Then the valves 19 are closed. Subsequently the traverse 8 is lowered with the segments 9 down to the new sleeves for the rolls 3 that have meanwhile been loaded into the winding machine. The segments 9 to start with help with winding of the web leading ends on the new sleeves and subsequently bring to bear the desired linear contact pressure at the contact lines between the support rollers 1 and 2 and the winding rolls 3.

The decreasing contact pressure necessary for increasing winding-roll diameter is controlled in accordance with the winding-roll diameter by the piston-cylinder units 10 working against the weight to the pressure-roller system.

We claim:

1. In a winding machine having:

a pair of horizontal and rotating support rollers defining an upwardly open rolling cradle holding a plurality of winding rolls all extending along a common axis;

means for feeding respective webs to the winding rolls, whereby the webs are wound up on the rotating winding rolls;

a horizontal and vertically displaceable traverse extending a full working width of the machine above and parallel to the winding rolls;

a row of coaxial roller segments downwardly engaging the winding rolls underneath the traverse;

respective roller mounts carrying the roller segments on the traverse for vertical movement independently of one another; and means for urging the roller segments downward against the winding rolls, the improvement comprising means including respective elements braced between the traverse and the roller segments for urging the segments downward with a force that decreases as vertical spacing from the traverse increases and increases as vertical spacing from the traverse decreases.

2. The improved winding machine defined in claim 1 wherein the machine is provided on the traverse with a respective vertical linear guide for each roller mount.

3. The improved winding machine defined in claim 1 wherein each element is a compression spring braced between the respective roller mount and the traverse.

4. The improved winding machine defined in claim 1 wherein each element is a tension spring engaged between the respective roller mount and the traverse.

5. The improved winding machine defined in claim 1 wherein the means for urging includes respective hydraulic piston-cylinder units braced between the mounts and the traverse.

6. The improved winding machine defined in claim 5 wherein the means for urging includes a conduit interconnecting chambers of all the hydraulic piston-cylinder units.

7. The improved winding machine defined in claim 6 wherein the piston-cylinder units are each double acting and each have a liquid-filled chamber connected to the other liquid-filled chambers by the conduit and an air-filled chamber.

8. The improved winding machine defined in claim 7 wherein the air-filled chambers constitute the elements.

9. The improved winding machine defined in claim 1 wherein each roller segment has an outer surface formed by a deformable layer of a cellular plastic material with a number of uniformly distributed pores and a modulus of compression K of less than 10 MPa.

10. The improved winding machine defined in claim 9 wherein the layer is formed of a cellular elastomer with a modulus of compression K of between 1 MPa and 5 MPa.

11. The improved winding machine defined in claim 9 wherein the pores have a size less than 5 mm.

12. The improved winding machine defined in claim 9 wherein the bores are partly open and partly closed, the proportion of open bores being 30% to 70%.

13. The improved winding machine defined in claim 1 wherein each roller segment has an outer surface formed by a deformable layer of a rubber-like material with a Shore A hardness between 60 and 90 and whose outer surface is formed with annular grooves.

14. The improved winding machine defined in claim 13 wherein a width of lands between the grooves is at most 3 mm.

15. The improved winding machine defined in claim 13 wherein a thickness of the layer is 8 mm to 40 mm.

16. The improved winding machine defined in claim 1, further comprising:

a piston-cylinder unit carrying the traverse and vertically extensible and contractile for vertically displacing the traverse.

* * * * *